United States Patent [19]

Ueno

[11] Patent Number: 4,987,022

[45] Date of Patent: Jan. 22, 1991

[54] NON-INFLAMMABLE LIGHT-WEIGHING TOUGH BOARD

[75] Inventor: Keisuke Ueno, No. 3010-17, Nogawa, Miyamae-ku, Kawasaki-shi, Kanagawa 213, Japan

[73] Assignees: Keisuke Ueno, Kanagawa; United Board Co., Ltd.; K. S. Consult Service Co., Inc., both of Tokyo, all of Japan

[21] Appl. No.: 388,722

[22] Filed: Jul. 31, 1989

Related U.S. Application Data

[63] Continuation of Ser. No. 170,883, Mar. 21, 1988, abandoned.

[51] Int. Cl.[5] ..... B32B 3/28; D21H 11/00

[52] U.S. Cl. ..... 428/182; 428/184; 428/537.1; 428/537.5; 428/541; 428/921; 162/109; 162/123; 162/141; 162/156; 162/159; 52/796

[58] Field of Search ..... 428/72, 73, 116, 178, 428/179, 180, 181, 182, 183, 184, 186, 453, 920, 921, 448, 449, 452, 704, 325, 325, 537.1, 537.5, 540, 541, 543; 52/795, 796; 162/109, 116, 117, 123, 135, 141, 156, 159

[56] References Cited

U.S. PATENT DOCUMENTS

| | | | |
|---|---|---|---|
| 1,855,161 | 4/1932 | Wyman | 428/188 |
| 3,259,536 | 7/1966 | Gaeth et al. | 428/239 |
| 3,811,992 | 5/1974 | Handa et al. | 428/453 |
| 3,896,763 | 7/1975 | Lau et al. | 118/50 |
| 3,958,998 | 5/1976 | Atterbury | 106/38.22 |
| 3,972,763 | 8/1976 | Wolvin et al. | 428/182 |
| 4,748,066 | 5/1988 | Kelly et al. | 428/184 |

*Primary Examiner*—Ellis P. Robinson
*Assistant Examiner*—Donald J. Loney
*Attorney, Agent, or Firm*—McGlew & Tuttle

[57] ABSTRACT

Non-inflammable light-weighing tough boards to be used for structural and decorative material in housing and building, such as, decorative ceiling boards, sliding door overlays, partitions and so on, prepared by corrugating cardboard made of phosphated wood pulp and inorganic fiber and processing the so obtained corrugated board by impregnating with a toughening solution of inorganic toughening agent and then drying it.

3 Claims, No Drawings

NON-INFLAMMABLE LIGHT-WEIGHING TOUGH BOARD

This is a continuation application of application Ser. No. 170,883, filed Mar. 21, 1988, now abandoned.

BACKGROUND OF THE INVENTION

1. Field of the Invention

Present invention relates to non-inflammable light-weighing tough boards, in particular, corrugated cardboards to be used for structural and decorative material in housings and buildings, such as, ceiling decorative boards, sliding door overlays, partitions and so on.

2. Description of the Prior Art

While there are used for manufacturing non-inflammable interior construction materials such as ceiling boards etc., non-inflammable excelsior boards and boards made from mineral wools, such as, gypsum whisker, whiskered blast furnace slag, glass wool and so on, all these prior art materials are heavy in weight and are inconvenient in the transport and in the assemblage work etc. On the other hand, there have also been found in the market sheet products made or paper toughend by impregnating with synthetic resins, such as phenol resin etc. However, they are not cost-saving, since high price chemical products are used for the manufacture thereof.

SUMMARY OF THE INVENTION

The object of the present invention is to provide non-inflammable light-weighing tough boards of low price.

Using water-glass for the impregnating agent, one may expect a cost-saving. When paper is impregnated with this chemical, however, the thus obtained impregnated paper will soon deteriorate and become tattered, since water-glass is a strong alkaline material.

The inventor had given his attention to the fact that phosphated pulp, namely, pulp esterified with phosphonic acid, is non-inflammable and it is paper is producible with phosphonic acid which is resistant to strong-alkali upon the admixing to this phosphated pulp ceramic fiber or glass fiber.

Therefore, the inventor had tried to prepare cardboards of profiled section by corrugating (that is, processing into a truss or honeycomb structure) cardboard of such phosphated pulp and then impregnating the so corrugated board with water-glass. This resulted in corrugated cardboard which was not only non-inflammable but also light-weight and tough.

This cardboard was found to be excellent in absorbing sound, since the porosity of the inorganic fiber interstices was retained therein.

DESCRIPTION OF PREFERRED EMBODIMENTS

EXAMPLE 1

50% by weight of phosphated wood pulp and 50% by weight of a glass wool product were mixed together and, from this mixture, paper was prepared, which had the following characteristic values:

| | |
|---|---|
| Basis weight | 170.0 g |
| Thickness | 0.72 |
| Density | 0.24 |
| Tensile modulus | 12.9 Kg |

This paper was corrugated and the so corrugated paper board was then impregnated with a toughening solution based on sodium silicate and was dried.

The so obtained board exhibited a strength of 3.6 $Kg/m^2$, in contrast to that of 1.2 $Kg/m^2$ for the original corrugated board the impregnation.

EXAMPLE 2

The paper which was prepared from a mixture of 70% by weight of phosphated wood pulp with 30% by weight of a glass fiber product had the following characteristic values:

| | |
|---|---|
| Basis weight | 170.0 g |
| Thickness | 0.69 |
| Density | 0.25 |
| Tensile modulus | 12.6 Kg |

Subsequently, this paper was processed by corrugating and impregnating it with a toughening solution based on sodium silicate and was then dried.

The so obtained board exhibited a strength of 3.0 $Kg/m^2$, whereas that of the corrugated board before the processing was 1.2 $Kg/m^2$. The cardboard processed in accordance with the present invention was found to withstand to a burn-through test at 800° C. for more than 5 minutes, whereas the cardboard without being subjected to such processing was burnt down within 2–3 seconds in the test.

The cardboard according to the present invention as prepared as above is light-weighing and therefore is easy in handling. The cardboard is of low price, since it is made of phosphated pulp, glass fiber and water-glass. It is thus able to provide products having sound absorbing property owing to the porosity by glass fiber. Due to the corrugated structure and the toughening treatment by the impregnating agent, the cardboard according to the present invention is tough and, in addition, non-inflammable, since the cardboard is made of phosphated wood pulp, glass fiber and the impregnated inorganic salt.

What is claimed is:

1. A board structure, comprising:

paper sheets including from 50% to 70% by weight phosphated wood pulp formed of wood pulp and phosphonic acid, and from 30% to 50% by weight of one of ceramic fiber and glass fiber, said paper sheets being corrugated; and, a toughening solution formed of an organic impregnating agent, said toughening solution being positioned on and impregnating said paper sheets.

2. A board according to claim 1, wherein said toughening solution is a strong alkali.

3. A board according to claim 1, wherein said toughening solution is water-glass.

* * * * *

UNITED STATES PATENT AND TRADEMARK OFFICE

CERTIFICATE OF CORRECTION

PATENT NO. : 4,987,022

DATED : January 22, 1991

INVENTOR(S) : UENO

It is certified that error appears in the above-identified patent and that said Letters Patent is hereby corrected as shown below:

Column 2, line 7, claim 1, please change: "organic" to: --inorganic--

Signed and Sealed this

Tenth Day of August, 1993

*Attest:*

Michael K. Kirk

MICHAEL K. KIRK

*Attesting Officer*

*Acting Commissioner of Patents and Trademarks*